US005722120A

United States Patent [19]

Bindschatel et al.

[11] Patent Number: 5,722,120

[45] Date of Patent: Mar. 3, 1998

[54] PRE-STAMPED HALF-HINGE ADHERENT COVER

[76] Inventors: Lyle D. Bindschatel; Debra L. Bindschatel, both of 7617 Wood Rd., Corryton, Tenn. 37721

[21] Appl. No.: 770,837

[22] Filed: Dec. 20, 1996

Related U.S. Application Data

[63] Continuation-in-part of Ser. No. 756,176, Nov. 25, 1996.

[51] Int. Cl.[6] ..... E05D 11/00

[52] U.S. Cl. ..... 16/250; 16/251; 118/505

[58] Field of Search ..... 16/250, 251; 118/301, 118/505, 504

[56] References Cited

U.S. PATENT DOCUMENTS

| | | | |
|---|---|---|---|
| 3,961,602 | 6/1976 | Dresser | 118/505 |
| 4,796,330 | 1/1989 | Ziegler | 16/251 |
| 4,802,259 | 2/1989 | Geslewitz | 16/251 |
| 5,056,191 | 10/1991 | Love | 16/250 |
| 5,224,240 | 7/1993 | Smith et al. | 118/505 |

*Primary Examiner*—Chuck Mah

[57] ABSTRACT

A Pre-stamped Half-hinge Adherent Cover designed to thoroughly protect all exposed surfaces of a half-hinge attached within the hinge recess of a door or jamb during the operation of coating and which combines the advantages of rigid covers (easy and quick to align and apply) with the advantages of flexible adhesive covers (securely remains in place and less expensive). In the preferred embodiment, numerous Pre-stamped Half-hinge Adherent Covers are provided on a roll so a painter can quickly and easily peel one off the roll and apply it to a half-hinge, greatly reducing the time involved in preparing a door or jamb to be coated and replacing the door in its jamb.

8 Claims, 2 Drawing Sheets

PRE-STAMPED HALF-HINGE ADHERENT COVER

This application is a continuation-in-part of application Ser. No. 08/756,176 filed Nov. 25, 1996.

FIELD OF THE INVENTION

This invention relates to a means to protect half-hinges while the door or jamb is being coated, especially spray coated using an air compressor.

BACKGROUND AND PRIOR ART

When a professional painting contractor has numerous doors to coat with paint, stain, polyurethane or the like. At is very expeditious to spray the coating using an air compressor. Doors cannot be spray coated while affixed to the jamb without shielding a large area from overspray. Since there is no product available which adequately protects a half-hinge during the process of coating a door or jamb and especially having a reasonable cost, painters are continuing to use two..or more pieces of plain tape to cover the half-hinge and then trim the tape to fit. Or painters remove the half-hinges and replace them later. All of these operations are very time-consuming and therefore relatively expensive. Painting contractors have a definite need for a means to thoroughly protect a half-hinge quickly and inexpensively.

Heretofore, several inventions have attempted to address this issue. The following hinge masks were found in the prior art:

| Patent Number | Date | Patentee | Class |
|---|---|---|---|
| 3,961,602 | 6/1976 | Dresser | 118/505 |
| 4,195,590 | 4/1980 | Herrington | 118/505 |
| 4,796,330 | 1/1989 | Ziegler | 16/251 |
| 4,802,259 | 2/1989 | Geslewitz | 16/251 |
| 5,056,191 | 10/1991 | Love | 16/251 |
| 5,224,240 | 7/1993 | Smith et al. | 16/251 |
| 5,432,979 | 7/1995 | Harper | 16/251 |

Ziegler and Love both show a hinge mask with an adhesive back. These hinge masks are designed to cover the full hinge, that is, the door is not removed from the jamb. One main disadvantage of this method is that the door cannot be spray-coated without shielding a large area from overspray, a tedious task for even one door. In addition, Love has left some edges of the hinge uncovered, therefore unprotected from some coating getting on the exposed edges. Furthermore, Ziegler and Love have not addressed the problem that if the adhesive face of the mask is applied to the hinge knuckles, which rotate in opposite directions, any movement of the door will disengage or tear the mask, rendering it useless.

Herrington, Geslewitz, Smith et al., and Harper show half-hinge masks composed of rigid material. These would be quite expensive to manufacture due to the high cost of precision molds, and for that reason only one is on the market. Painting contractors are unwilling to pay for a hinge mask unless it adequately protects the hinge and the cost is lower than the labor cost for the time saved.

Herrington, Geslewitz and Harper do not address the problem of protecting the top and bottom edges of the knuckles of the portion of the hinge leaf which protrudes from the hinge recess on the door or jamb.

Geslewitz has a longitudinal tab 32 projecting outwardly which covers part of the door or jamb, as can be seen in FIG. 4, preventing the coating from being applied to those areas and requiring the painter to carefully coat these areas later with a brush.

Smith et al. has addressed the necessity of covering the top and bottom edges of the hinge leaf and knuckles, however the large panel 14 has no adherent means to hold it against the hinge leaf securely. When tested during spray painting using an air compressor, the pressure forced this large panel away from the hinge leaf, allowing the paint to intrude.

Harper has also not addressed the problem of spray pressure forcing the plate 14 away from the hinge leaf and allowing the coating to intrude. Harper states "cut 11 weakens tube 13 along a line from top to bottom . . . " and this cut will prevent the shield from remaining in the desired position when air pressure is used to apply the coating.

Dresser shows a flexible mask for half-hinges with pressure sensitive adhesive however this mask does not cover the top and bottom edges of the knuckles nor the top and bottom edges of the part of the half-hinge which protrudes from the hinge recess. Therefore the painter must either separately cover these exposed edges with tape or clean the coating off later, both consuming additional time, defeating the purpose.

None of the above-mentioned inventions satisfactorily meets the requirements of a painting contractor.

OBJECTS OF THE INVENTION

The object of this invention is to provide a cover for a half-hinge within the hinge recess of a door or jamb which combines the advantages of rigid covers (easy and quick to align and apply) with the advantages of flexible adhesive covers (securely remains in place and less expensive) while providing a half-hinge cover which protects every exposed surface.

DESCRIPTION OF THE INVENTION

Figure 1:
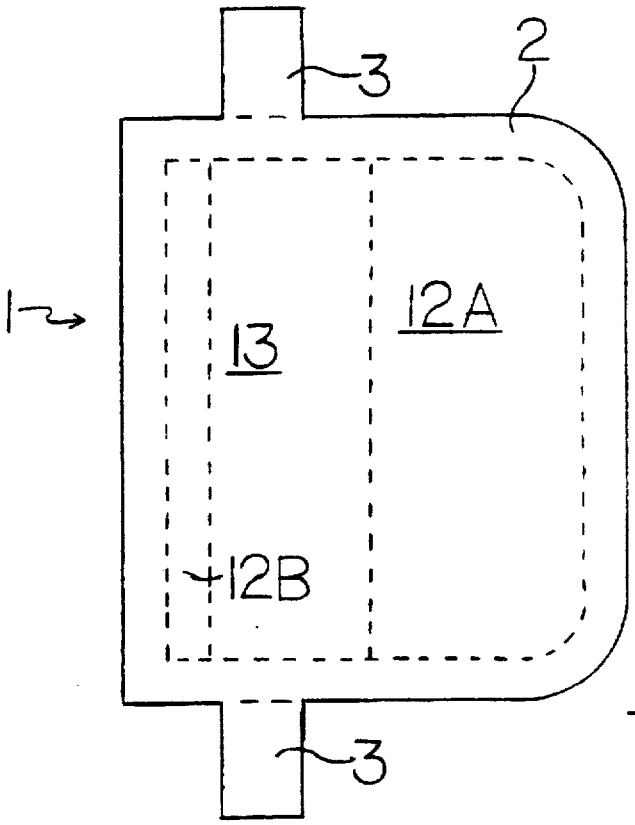
FIG. 1 is a plan view of one Pre-stamped Half-hinge Adherent Cover and indicates the alignment guides on the inner surface.
Figure 2:
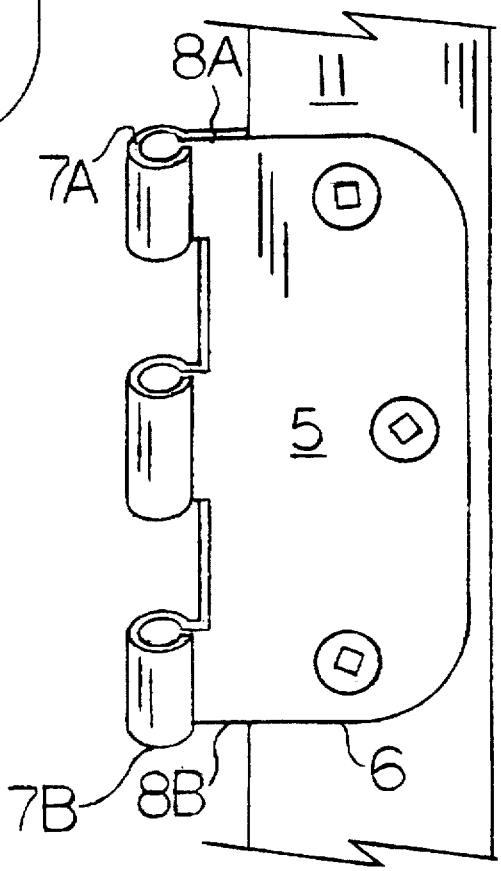
FIG. 2 shows a half-hinge in the hinge recess of a door or jamb which the Pre-stamped Half-hinge Adherent Cover is designed to protect.

The Pre-stamped Half-hinge Adherent Cover 1, as shown in FIG. 1, is shaped to cover all exposed surfaces of a half-hinge 5 which is attached within the hinge recess 6 of a door or jamb 11, as shown in FIG. 2.

The inner surface 1A of the Pre-stamped Half-hinge Adherent Cover 1 is coated with a pressure sensitive material.

The main body 2 covers the major surfaces of the half-hinge 5, that is, the outer surface, the knuckles, and the inner surface protruding from the hinge recess 6 of a door or jamb 11.

On the inner surface 1A of the Pre-stamped Half-hinge Adherent Cover 1 are an alignment guide 12A for the outer surface of the half-hinge 5, an alignment guide 12B for the inner surface of the half-hinge 5, and a flexible guide 13 for the knuckles of the half-hinge 5, none of which is adherent to the half-hinge 5. The purpose of the alignment guides 12A, 12B is to provide a quick alignment of the Pre-stamped Half-hinge Adherent Cover 1 onto the half-hinge 5 while still providing an adherent perimeter on the inner surface 1A to engage the half-hinge securely. These alignment guides 12A, 12B are therefore less flexible than the main body 2.

Two tabs 3 are provided projecting outwardly from the main body 2 and opposite each other. One tab 3 folds to cover the top edge 7A of the top knuckle and the top edge 8A of the half-hinge 5 protruding from the hinge recess 6. The opposite tab 3 folds to cover the bottom edge 7B of the bottom knuckle and the bottom edge 8B of the half-hinge 5 protruding from the hinge recess 6. The corners of the tabs 3 may be pinched over to adhere to the main body 2.

In the case of the half-hinge with only two knuckles, not shown, the main body 2 conforms to the barrel shape of the knuckles and the tabs 3 will fold and adhere to the Pre-stamped Half-hinge Adherent Cover 1 itself and the edges 8A, 8B to still provide thorough protection.

The adherent on the perimeter of the inner surface 1A securely holds the Pre-stamped Half-hinge Adherent Cover 1 in position while the door or jamb 11 is being coated, even when spraying the coating using an air compressor. After the coating has dried, the Pre-stamped Half-hinge Adherent Cover 1 can be peeled off easily, and with the proper adherent, will leave no residue on the half-hinge 5.

Figure 3:
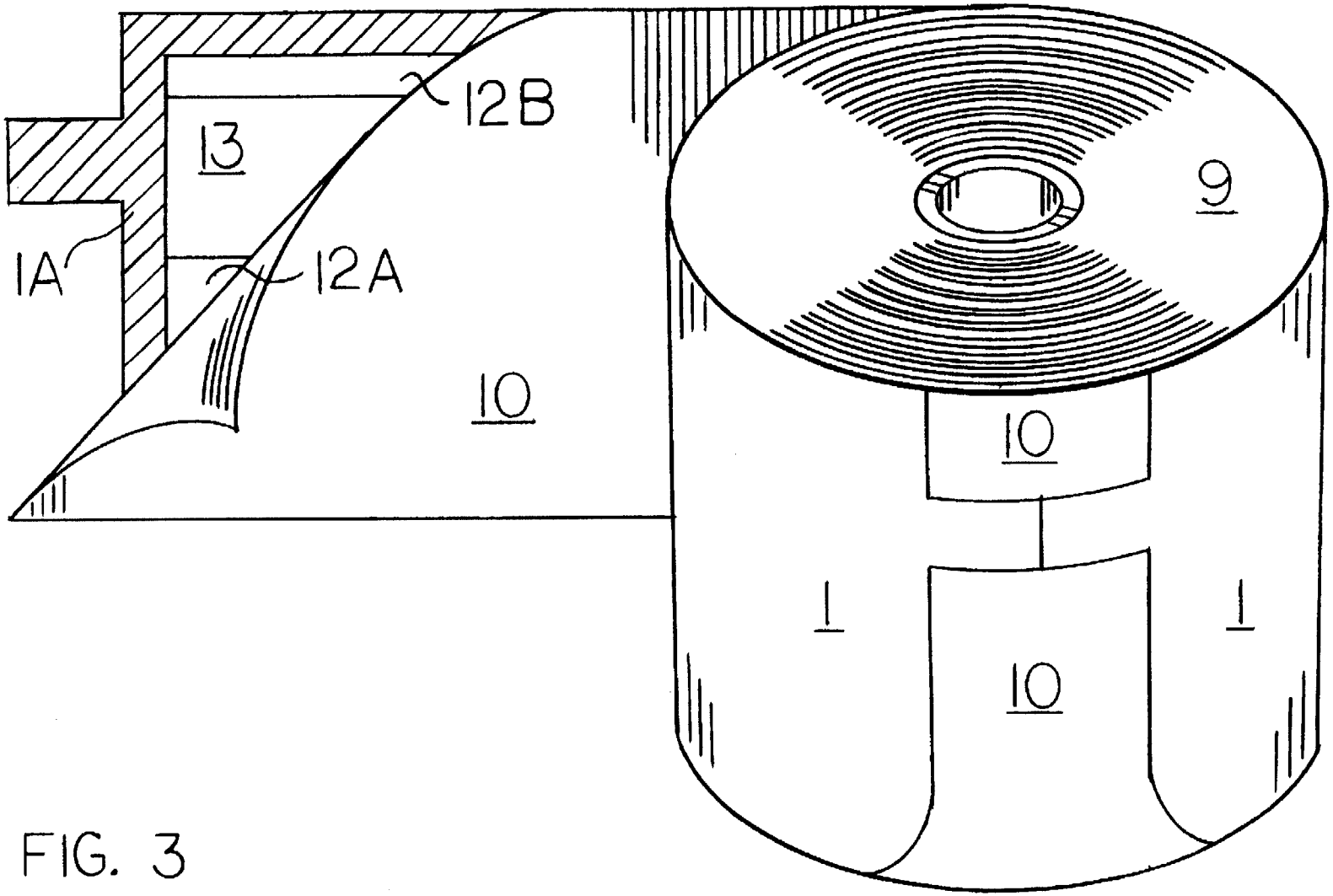
FIG. 3 shows the embodiment wherein numerous Pre-stamped Half-hinge Adherent Covers are provided on a roll and the backing material being peeled away from the adherent coated areas of the inner surface of a Pre-stamped Half-hinge Adherent Cover.

In one preferred embodiment, the Pre-stamped Half-hinge Adherent Covers 1 would be provided on a roll 9, as shown in FIG. 3, whereby a Pre-stamped Half-hinge Adherent Cover 1 can be peeled off the backing material 10 and applied to a half-hinge 5 quickly and easily. This roll 9 would contain perhaps six hundred Pre-stamped Half-hinge Adherent Covers 1, enough for one hundred doors and their jambs, for the convenience of professional painting contractors and at a reasonable price, not significantly higher than a normal roll of tape of comparable size, thereby providing a quick, efficient means to thoroughly protect every exposed surface of half-hinges 5 during the process of coating a door or jamb 11.

While the above description contains specificities, these should not be construed as limitations on the scope of the invention, but rather as an example of one preferred embodiment thereof. Variations are possible, for example the Pre-stamped Half-hinge Adherent Cover could be configured to the shape and size of any commonly used hinge. Accordingly, the scope of this invention should be determined not by the embodiment illustrated, but by the appended claims and their legal equivalent.

Having thus described the aforementioned invention,

We claim:

1. A Pre-stamped Half-hinge Adherent Cover for use in combination with all exposed surfaces of a half-hinge attached within a hinge recess of a door or jamb, said exposed surfaces of said half-hinge comprised of an outer surface, knuckles, an inner surface protruding from said hinge recess, a top edge of the top one of said knuckles, a bottom edge of the bottom one of said knuckles, a top edge of said half-hinge protruding from said hinge recess, and a bottom edge of said half-hinge protruding from said hinge recess, said Pre-stamped Half-hinge Adherent Cover comprising a thin, flexible material having an outer surface and an inner surface, said inner surface of said cover being coated with a pressure sensitive adherent, said Pre-stamped Half-hinge Adherent Cover further comprising:

a main body to cover said outer surface of said half-hinge, said knuckles of said half-hinge, and said inner surface of said half-hinge, said inner surface of said main body having a less flexible non-adherent alignment guide for alignment of said Pre-stamped Half-hinge Adherent Cover on said outer surface of said half-hinge, said alignment guide being surrounded by a revealed perimeter of said pressure sensitive adherent, two opposite tabs protruding from the top and bottom of said main body respectively, one of said tabs positioned to fold and cover said top edge of said top one of said knuckles and said top edge of said half-hinge protruding from said hinge recess and the opposite one of said tabs positioned to fold and cover said bottom edge of said bottom one of said knuckles and said bottom edge of said half-hinge protruding from said hinge recess.

2. The Pre-stamped Half-hinge Adherent Cover of claim 1 being provided with a backing material, said inner surface of said Pre-stamped Half-hinge Adherent Cover being peelably removable from said backing material and adherently appliable to said exposed surfaces of said half-hinge.

3. The Pre-stamped Half-hinge Adherent Cover of claim 1 also comprising a second less flexible non-adherent alignment guide on said inner surface of said main body for alignment of said Pre-stamped Half-hinge Adherent Cover on said inner surface of said half-hinge, said second alignment guide being surrounded by a revealed perimeter of said pressure sensitive adherent.

4. The Pre-stamped Half-hinge Adherent Cover of claim 3 being provided with a backing material, said inner surface of said Pre-stamped Half-hinge Adherent Cover being peelably removable from said backing material and adherently appliable to said exposed surfaces of said half-hinge.

5. The Pre-stamped Half-hinge Adherent Cover of claim 3 also comprising a non-adherent flexible guide on said inner surface of said main body for said knuckles of said half-hinge, said flexible guide being bordered at least above and below by said pressure sensitive adherent.

6. The Pre-stamped Half-hinge Adherent Cover of claim 5 being provided with a backing material, said inner surface of said Pre-stamped Half-hinge Adherent Cover being peelably removable from said backing material and adherently appliable to said exposed surfaces of said half-hinge.

7. The Pre-stamped Half-hinge Adherent Cover of claim 1 also comprising a non-adherent flexible guide on said inner surface of said main body for said knuckles of said half-hinge, said flexible guide being bordered at least above and below by said pressure sensitive adherent.

8. The Pre-stamped Half-hinge Adherent Cover of claim 7 being provided with a backing material, said inner surface of said Pre-stamped Half-hinge Adherent Cover being peelably removable from said backing material and adherently appliable to said exposed surfaces of said half-hinge.

* * * * *